US010299032B2

(12) United States Patent
Grazian et al.

(10) Patent No.: US 10,299,032 B2
(45) Date of Patent: May 21, 2019

(54) FRONT PORT RESONATOR FOR A SPEAKER ASSEMBLY

(71) Applicant: Apple Inc., Cupertino, CA (US)

(72) Inventors: Anthony P. Grazian, Los Gatos, CA (US); Christopher Wilk, Los Gatos, CA (US); Claudio Notarangelo, San Francisco, CA (US); Hongdan Tao, Sunnyvale, CA (US); Michael J. Newman, Cupertino, CA (US); Onur I. Ilkorur, Campbell, CA (US); Thomas H. Tsang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/701,335

(22) Filed: Sep. 11, 2017

(65) Prior Publication Data

US 2019/0082252 A1 Mar. 14, 2019

(51) Int. Cl.
*H04R 1/28* (2006.01)
*H04R 9/06* (2006.01)

(52) U.S. Cl.
CPC ..... *H04R 1/2811* (2013.01); *H04R 9/06* (2013.01); *H04R 2201/003* (2013.01)

(58) Field of Classification Search
CPC .. H04R 1/2807; H04R 1/2819; H04R 1/2823; H04R 1/2826; H04R 1/28
See application file for complete search history.

(56) References Cited

U.S. PATENT DOCUMENTS 2,880,817 A 4/1959 Burns et al.
4,410,064 A 10/1983 Taddeo
(Continued)

FOREIGN PATENT DOCUMENTS

CN 1140970 A 1/1997
CN 1706231 12/2005
(Continued)

OTHER PUBLICATIONS

Extended European Search Report dated Apr. 3, 2013, EP Appln. No. 12189363.0.
(Continued)

*Primary Examiner* — Sunita Joshi
(74) *Attorney, Agent, or Firm* — Womble Bond Dickinson (US) LLP

(57) ABSTRACT

A micro-speaker assembly including an enclosure having an enclosure wall separating a surrounding environment from an encased space, wherein the enclosure wall defines an acoustic port from the encased space to the surrounding environment; a sound radiating surface positioned within the encased space and dividing the encased space into a front volume chamber and a back volume chamber, wherein the front volume chamber is acoustically coupled to a first surface of the sound radiating surface and the acoustic port, and the back volume chamber acoustically coupled to a second surface of the sound radiating surface; and a resonator acoustically coupled to the front volume chamber, wherein the resonator comprises a neck acoustically coupled to an acoustic cavity, and an opening to the neck is positioned at a distance from the acoustic port that corresponds to a quarter wavelength resonance of the front volume chamber.

20 Claims, 8 Drawing Sheets

(56) References Cited

U.S. PATENT DOCUMENTS

| | | | | |
|---|---|---|---|---|
| 5,022,486 | A | 6/1991 | Miura et al. | |
| 5,225,639 | A | 7/1993 | Kobayashi et al. | |
| 5,261,006 | A | 11/1993 | Nieuwendijk et al. | |
| 5,696,357 | A | 12/1997 | Starobin | |
| 5,710,395 | A | 1/1998 | Wilke | |
| 5,737,435 | A | 4/1998 | De Poortere et al. | |
| 6,130,951 | A | 10/2000 | Nakamura et al. | |
| 6,278,789 | B1 | 8/2001 | Potter | |
| 6,356,643 | B2 | 3/2002 | Yamagishi et al. | |
| 6,668,064 | B1 * | 12/2003 | Lin | H04R 1/1016 381/328 |
| 6,751,330 | B2 | 6/2004 | Kowaki et al. | |
| 7,433,483 | B2 | 10/2008 | Fincham | |
| 7,840,023 | B2 | 11/2010 | Eaton | |
| 7,869,617 | B2 | 1/2011 | Jang et al. | |
| 8,213,666 | B2 | 7/2012 | Groesch | |
| 8,290,179 | B2 | 10/2012 | Gregg et al. | |
| 9,107,003 | B2 | 8/2015 | Dix et al. | |
| 2013/0148834 | A1 | 6/2013 | Seo | |
| 2016/0192065 | A1 * | 6/2016 | Oosato | H04R 1/2826 381/378 |

FOREIGN PATENT DOCUMENTS

| | | | |
|---|---|---|---|
| CN | 102934463 | A | 2/2013 |
| CN | 103200501 | A | 7/2013 |
| DE | 19601217 | | 7/1997 |
| EP | 0360517 | | 3/1990 |
| EP | 0429121 | | 5/1991 |
| EP | 0744880 | | 11/1996 |
| GB | 2408405 | | 5/2005 |
| GB | 2463529 | | 3/2010 |
| JP | 08331685 | | 12/1996 |
| JP | 2606447 | | 2/1997 |
| JP | 09149487 | | 6/1997 |
| JP | 10066184 | | 3/1998 |
| JP | 11259011 | | 9/1999 |
| JP | 2000115898 | | 4/2000 |
| JP | 2001145186 | | 5/2001 |
| KR | 1020100129629 | | 12/2010 |
| WO | WO-9119406 | | 12/1991 |
| WO | WO-9945742 | | 9/1999 |

OTHER PUBLICATIONS

Final Office Action dated Aug. 30, 2013, U.S. Appl. No. 13/327,649, filed Dec. 15, 2011.

International Preliminary Report on Patentability for correspondence International Application No. PCT/US2012/057346, dated Jun. 26, 2014, 9 pages.

PCT Search Report and Written Opinion dated Dec. 21, 2012, PCT Appln. No. PCT/US2012/057346 filed Sep. 26, 2012.

Chinese Office Action dated Jan. 19, 2015, Chinese Appln. No. 201210424356.9 with English-language translation, 26 pages.

Australian Office Action dated Jun. 5, 2014, Australian Appln. No. 2012238200, 3 pages.

Australian Office Action dated Sep. 10, 2013, Australian Appln. No. 2012238200, 3 pages.

Canadian Office Action dated Oct. 17, 2014, Canadian Appln. No. 2,731,432, 4 pages.

Japanese Office Action dated Jun. 11, 2014, Japanese Appln. No. 2012-234178, with English translation, 5 pages.

Japanese Office Action dated Oct. 17, 2013, Japanese Appln. No. 2012-234178, with English translation, 6 pages.

Korean Office Action dated Oct. 28, 2013, Korean Appln. No. 10-2012-120915, with English translation, 6 pages.

Apple Inc., Non-final Office Action dated Apr. 11, 2013, U.S. Appl. No. 13/327,649, filed Dec. 15, 2011.

Russell, D. A. "Acoustic high-pass, low-pass, and band-stop filters", http://www.kettering.edu/physics/drussell/GMI-Acoustics/Filters.html, GMI Engineering & Management Institute; Kettering University, Mar. 6, 1997, 8 pages.

Utility Model Patent Evaluation Report (UMPER) dated Dec. 4, 2018, for related Chinese Patent Appin. No. ZL2018201131085 4 Pages.

* cited by examiner

FRONT PORT RESONATOR FOR A SPEAKER ASSEMBLY

FIELD

This application relates generally to a speaker having a resonator, more specifically a micro speaker having a resonator that is acoustically coupled to a front port to extend a frequency bandwidth of the micro speaker, and therefore improve a quality of sound emitted from the micro speaker system. Other embodiments are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakerphone loudspeakers and earpiece receivers that can benefit from improved audio performance. Smart phones, however, do not have sufficient space to house much larger high fidelity sound output devices. This is also true for some portable personal computers such as laptop, notebook, and tablet computers, and, to a lesser extent, desktop personal computers with built-in speakers. Many of these devices use what are commonly referred to as "micro speakers." Micro speakers are a miniaturized version of a loudspeaker, which use a moving coil motor to drive sound output. The moving coil motor may include a diaphragm (or sound radiating surface), voice coil and magnet assembly positioned within a frame. The input of an electrical audio signal to the moving coil motor causes the diaphragm to vibrate and output sound. The sound may be output from the sound output surface of the diaphragm to a sound output port through a front volume chamber that acoustically couples the sound output face to the output port. A back volume chamber may further be formed around the opposite face of the diaphragm to enhance sound output quality. Due to increasing demands for relatively low profile devices, particularly in the z-height dimension, however, it is becoming increasingly difficult to maximize a sound output of the system.

SUMMARY

In one embodiment, the invention is directed to a transducer assembly having a front port resonator configured to widen a working or fundamental frequency bandwidth of the transducer. The term "fundamental" is intended to refer to the first resonance frequency of the acoustic pathway, channel or chamber through which the sound travels to the surrounding environment, and can also be referred to as the quarter wavelength. More specifically, due to cosmetic requirements and size constraints, for example in micro speaker enclosures, the sound radiating surface of the speaker may not be positioned next to the cosmetic opening (e.g. sound outlet) of the device. The sound waves generated by the sound radiating surface must therefore travel though an acoustic pathway before exiting the device. This pathway is constrained by a certain shape, which may change the amplitude of the sound waves at geometry dependent frequencies. In particular, every open-ended air channel, or a tube, has a fundamental frequency or quarter wavelength that is linked to the length of the channel or tube. This length may be the length at which only a quarter of the wavelength can occur in that length of tube. When the wavelength of the frequency, generated by the speaker, coincides with the quarter wavelength of the air channel length, the radiated sound loudness may increase. The frequency at which this occurs may be referred to as the Quarter Wave Resonance (QWR) of the tube. In addition, wave equation dictates that, at resonance, the phase shifts by 180 degrees. A 180 degree phase shift means the sound waves traveling inside the acoustic channel are out of phase with the speaker, therefore after this resonance, the loudness of the speaker diminishes significantly. Loss of high frequency loudness also has other implications in human perception of sound quality. The quality of a sound system is measured by the amount of frequencies it can cover without losing a certain amount of sound pressure level (SPL), also called the frequency bandwidth. This limit is defined to be −3 decibel (dB) and the aim is to keep it as wide as possible. Thus, the speaker assembly disclosed herein addresses the above-noted phenomenon by coupling a resonator to the front volume chamber and front port of the speaker. The resonator is tuned to resonate at a same frequency as a quarter wave resonances of the chamber and positioned at a particular location with respect to the front port such that it can increase the frequency bandwidth of the sound system by only acoustical means, and without changing the components of the driver (e.g., magnet, diaphragm, surround, coil, etc.).

Representatively, in one embodiment, the invention is directed to a micro speaker assembly including an enclosure having an enclosure wall separating a surrounding environment from an encased space, wherein the enclosure wall defines an acoustic port from the encased space to the surrounding environment. The assembly further includes a sound radiating surface positioned within the encased space and dividing the encased space into a front volume chamber and a back volume chamber. The front volume chamber may be acoustically coupled to a first surface of the sound radiating surface and the acoustic port, and the back volume chamber may be acoustically coupled to a second surface of the sound radiating surface. In addition, a resonator acoustically coupled to the front volume chamber is provided. The resonator may include a neck acoustically coupled to an acoustic cavity, and an opening to the neck positioned at a distance from the acoustic port that corresponds to a quarter wavelength resonance of the front volume chamber. The assembly may further include a voice coil extending from the second surface of the sound radiating surface and a magnet assembly having a magnetic gap aligned with the voice coil. In some embodiments, the distance from the acoustic port that corresponds to the quarter wavelength resonance is greater than a distance from the acoustic port to a center axis of the sound radiating surface. In addition, the resonator may be tuned to resonate at a same frequency as a quarter wave resonance of the front volume chamber such that it extends a frequency bandwidth of a sound generated by the sound radiating surface. Still further, the neck of the resonator may have a narrower cross-section than the acoustic cavity. In addition, the opening to the neck of the resonator may face a different direction than the acoustic port. Still further, the neck or the acoustic cavity of the resonator may have a tortuous acoustic pathway. In some embodiments, the resonator may be positioned within the enclosure and the acoustic cavity may occupy a portion of the back volume chamber within the encased space. The acoustic cavity may further be a closed acoustic cavity that is acoustically isolated from the back volume chamber. In some embodiments, the enclosure wall may have a top wall that is parallel to a bottom wall, and a side wall connecting the top wall to the bottom wall, and the resonator may be formed in part by at least one of the top wall, the bottom wall or the side wall. In addition, in some embodiments, the acoustic port may be positioned within the side wall.

In another embodiment, the invention is directed to a micro speaker assembly including an enclosure having an enclosure wall separating a surrounding environment from an encased space and which defines an acoustic port from the encased space to the surrounding environment. The assembly may further include a sound radiating surface positioned within the encased space and dividing the encased space into a front volume chamber acoustically coupled to a first surface of the sound radiating surface and a back volume chamber acoustically coupled to a second surface of the sound radiating surface, and the front volume chamber may be acoustically coupled to the acoustic port. In addition, a Helmholtz resonator acoustically coupled to the front volume chamber and the acoustic port may further be provided. The Helmholtz resonator may be positioned within the back volume chamber. In addition, the assembly may include a voice coil extending from the second surface of the sound radiating surface and a magnet assembly having a magnetic gap aligned with the voice coil. The Helmholtz resonator may be operable to extend a frequency bandwidth of a sound generated by the sound radiating surface in comparison to a micro speaker assembly without a Helmholtz resonator. For example, the Helmholtz resonator may be tuned to resonate at a same frequency as a quarter wave resonance of the front volume chamber. An opening to the Helmholtz resonator may be positioned at a pressure maximum of a quarter wave resonance of the front volume chamber. The Helmholtz resonator may be acoustically coupled to the front volume chamber at a location that is farther from the acoustic port than a center axis of the sound radiating surface. The Helmholtz resonator may further include an interior damping member that forms a tortuous acoustic pathway within the Helmholtz resonator. In some embodiments, a perimeter of the sound radiating surface is defined by four sides, and the Helmholtz resonator is positioned along a side of the sound radiating surface that is different than the acoustic port.

In other embodiments, the invention is directed to an electroacoustic transducer assembly including an enclosure separating a surrounding environment from an encased space, and which includes a top wall, a bottom wall and a side wall connecting the top wall to the bottom wall, and an acoustic port formed within the side wall and connecting the encased space to the surrounding environment. A driver may be positioned within the encased space and include a sound radiating surface dividing the encased space into a front volume chamber and a back volume chamber, wherein the front volume chamber is acoustically coupled to the acoustic port and defined in part by the top wall and a first surface of the sound radiating surface that faces the top wall, and the back volume chamber is defined in part by the bottom wall and a second surface of the sound radiating surface. A resonator acoustically coupled to the front volume chamber may further be provided. The resonator may include an acoustic channel having one end open to the front volume chamber and another end open to a closed acoustic cavity, and the closed acoustic cavity may be positioned within the back volume chamber. In addition, in some embodiments, one end of the acoustic channel is open to the front volume chamber at a location that is a distance from the acoustic port that corresponds to a quarter wavelength resonance of the front volume chamber, and the only acoustic pathway to the closed acoustic cavity is through the other open end of the acoustic channel.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
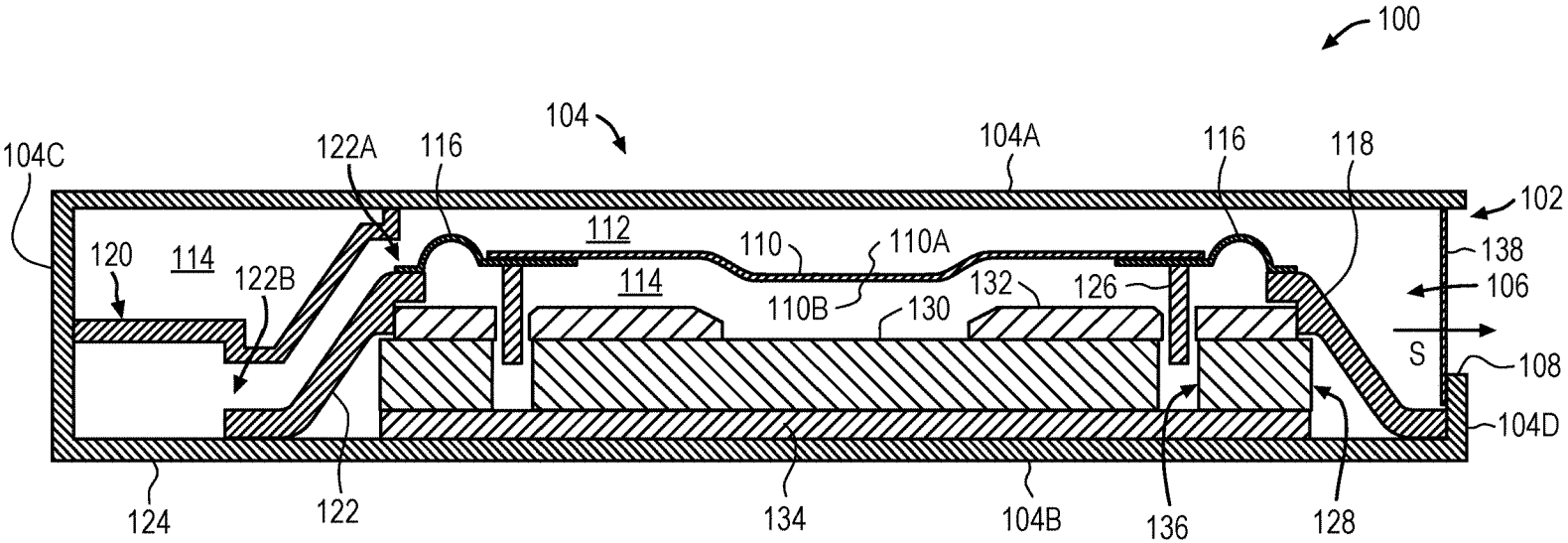
FIG. 1 illustrates a cross-sectional side view of one embodiment of a transducer assembly.

FIG. 1 illustrates a cross-sectional side view of one embodiment of a transducer. Transducer 100 may be, for example, an electroacoustic driver or transducer that converts electrical signals into audible signals that can be output from a device within which transducer 100 is integrated. For example, transducer 100 may be a micro speaker such as a speakerphone speaker or an earpiece receiver found within a smart phone, or other similar compact electronic device such as a laptop, notebook, tablet computer or portable time piece. Transducer 100 may be enclosed within a housing or enclosure of the device within which it is integrated. In some embodiments, transducer 100 may be a 10 mm to 75 mm driver, or 10 mm to 20 mm driver (as measured along the diameter or longest length dimension), for example, a micro speaker.

Transducer 100 may include an enclosure 102, which is made up of an enclosure wall 104 that separates a surrounding environment from an encased space 106. Each of the components of transducer 100, for example components of a speaker assembly as will be discussed herein, may be positioned within encased space 106 and therefore enclosed within enclosure wall 104. In some embodiments, enclosure wall 104 may include a wall 104A, a wall 104B and walls 104C-104D, which form a top side (or top wall), a bottom side (or bottom wall) and side walls, respectively, of enclosure 102. The wall 104A may be substantially parallel to the wall 104B, and walls 104C-104D may be perpendicular to the other walls, and connect wall 104A to wall 104B. In addition, at least one of the wall 104A or the wall 104B, and in some cases side walls 104C-104D (alone, in combination, or in combination with another encased transducer component) may form all, or a portion of, an acoustic channel or port 108. For example, the acoustic channel or port 108 may be formed between walls 104A-104B, or otherwise through a side wall 104D of enclosure 102, such that the transducer is considered a "side firing" device or system. The acoustic channel or port 108 may acoustically connect the encased space 106 to the surrounding environment. For example, in the case of a micro speaker, the acoustic channel or port 108 may be a port (or elongated channel) that is acoustically coupled to a sound radiating component of the transducer and outputs sound (S) produced by transducer 100 to the surrounding environment. In addition, in some embodiments, a protective barrier 138 may be positioned at an end of acoustic port or channel 108 to protect transducer 100 from particle or fluid ingress. In this aspect, sound (S) may travel through protective barrier 138 before reaching the surrounding environment.

In one embodiment, one of the components of transducer 100 (e.g., speaker assembly components) positioned within the encased space 106 may include a sound radiating surface (SRS) 110. The SRS 110 may also be referred to herein as an acoustic radiator, a sound radiator or a diaphragm. SRS 110 may be any type of flexible membrane capable of vibrating in response to an acoustic signal to produce acoustic or sound waves. SRS 110 may include a top face 110A, which generates sound to be output to a user, and a bottom face 110B, which is acoustically isolated from the top face 110A, so that any acoustic or sound waves generated by the bottom face 110B do not interfere with those from the top face 110A. The top face 110A may be considered the "top" face because it faces, or includes a surface substantially parallel to, the top or first enclosure wall 104A. Similarly, the bottom face 110B may be considered a "bottom" face because it faces, or includes a surface substantially parallel to, the bottom or second enclosure wall 104B. SRS 110 may have an out-of-plane region as shown (e.g. for geometric stiffening) or be substantially planar.

In some embodiments, SRS 110 may be suspended within enclosure 102 by a suspension member 116, which may be connected to enclosure 102 by a support member 118. Representatively, suspension member 116 may be a flexible membrane connected to a perimeter of SRS 110 along one side, and support member 118 along another side. In addition, in some embodiments, suspension member 116 may extend from one support member 118 to another, and SRS 110 may be a stiffening layer positioned on a top surface of suspension member 116. The support member 118 may be connected to, for example, the bottom or enclosure wall 104B. The support member 118 may be an additional wall, for example an interior wall, of enclosure 102. Support member 118 may be a separate structure that is attached to, for example an interior surface of enclosure wall 104B, or a structure that is integrally formed with enclosure wall 104.

As illustrated in FIG. 1, SRS 110 (in combination with suspension member 116 and/or support member 118), may divide the encased space 106 into a first acoustic chamber 112 and a second acoustic chamber 114. The first acoustic chamber 112 may be acoustically isolated from the second acoustic chamber 114. For example, the first acoustic chamber 112 may acoustically connect the top face 110A of SRS 110 to acoustic channel or port 108, and therefore be considered a front volume chamber. In this aspect, the first acoustic chamber 112 (or front volume chamber) may be considered between, and formed in part by, the top face 110A of the SRS 110 and first enclosure wall 104A, and in some cases a side wall of enclosure wall 104. The second acoustic chamber 114 may be acoustically coupled to the bottom face 110E and therefore be considered a back volume chamber. The second acoustic chamber 114 is therefore considered between, and formed in part by, the bottom face 110E of SRS 110 and wall 104B, and in some cases wall 104C (or other side walls).

The assembly may further include a resonator 120 connected to first chamber 112 to increase the frequency bandwidth of the sound (S) generated by the SRS 110. Resonator 120 may be considered a "front port resonator" in that it is acoustically coupled to, or in acoustic communication with, first chamber 112, which is considered a front volume chamber because it provides an acoustic channel for the sound (S) to travel to acoustic port 108. Resonator 120 may be any type of hollow chamber or cavity dimensioned to resonate at particular frequencies (e.g., resonance frequencies), with greater amplitude than at others. For example, in some embodiments, resonator 120 may be a Helmholtz resonator. More specifically, resonator 120 may include a channel or neck 122 and an acoustic cavity 124. The channel or neck 122 may have an opening 122A at one end to the first chamber 112, and an opening 122B at another end to an acoustic cavity 124. In this aspect, channel or neck 122 may define an acoustic pathway through which a sound (S) generated by SRS 110 may travel to and/or from acoustic cavity 124. Resonator 120 may further be positioned within the encased space 106 defined by enclosure 102 such that it is entirely contained within enclosure 102. For example, in some embodiments, resonator 120 may be formed by one or more walls that are interior to enclosure walls 104A-104C, or formed by one or more of enclosure walls 104A-104C. Acoustic cavity 124 may further be positioned within, and occupy a portion of, second chamber 114 (e.g., a back volume chamber). Acoustic cavity 124 may, however, be a closed cavity in that it includes only one opening, namely the opening 122B at one end of neck 122 to first chamber 112, and ultimately acoustic port 108. In this aspect, although acoustic cavity 124 is positioned within second chamber 114, its interior volume is acoustically isolated from, or is otherwise not shared with, second chamber 114. To achieve an increased frequency bandwidth, resonator 120 may be tuned to a resonate at a same frequency as a quarter wave resonance of first chamber 112, and be located at a particular location with respect to acoustic port 108, as will be discussed in more detail in reference to FIG. 2-FIG. 3.

Returning now to the interior components of transducer 100, transducer 100 may also include a voice coil 126 positioned along a bottom face 110E of SRS 110 (e.g., a face of SRS 110 facing magnet assembly 128). For example, in one embodiment, voice coil 126 includes an upper end directly attached to the bottom face 110B of SRS 110, such as by chemical bonding or the like, and a lower end. In another embodiment, voice coil 126 may be formed by a wire wrapped around a former or bobbin and the former or bobbin is directly attached to the bottom face 110E of SRS 110. In one embodiment, voice coil 126 may have a similar profile and shape to that of SRS 110. For example, where SRS 110 has a square, rectangular, circular or racetrack shape, voice coil 126 may also have a similar shape. For example, voice coil 126 may have a substantially rectangular, square, circular or racetrack shape.

Transducer 100 may further include a magnet assembly 128. Magnet assembly 128 may include a magnet 130 (e.g., a NdFeB magnet), with a top plate 132 and a yoke 134 for guiding a magnetic circuit generated by magnet 130. Magnet assembly 128, including magnet 130, top plate 132 and yoke 134, may be positioned such that voice coil 126 is aligned with magnetic gap 136 formed by magnet 130. For example, magnet assembly 128 may be below SRS 110, and in some cases, between SRS 110 and the bottom, or second enclosure wall 104B. In addition, in some embodiments, top plate 132 may be specially designed to accommodate an out-of-plane region (e.g., a concave or dome shaped region) of SRS 110. For example, top plate 132 may have a cut-out or opening within its center that is aligned with the out-of-plane region of SRS 110. In this aspect, the additional space created below the out-of-plane region of SRS 110 allows SRS 110 to move or vibrate up and down (e.g., pistonically) without contacting top plate 132. In this aspect, the opening may have a similar size or area as the out-of-plane region. In addition, although a one-magnet embodiment is shown here, although multi-magnet motors are also contemplated.

In addition, although not shown, transducer 100 my include circuitry (e.g., an application-specific integrated circuit (ASIC)) or other external components electrically connected to transducer 100 to, for example, drive current through the voice coil 126 to operate the transducer 100.

Figure 2:
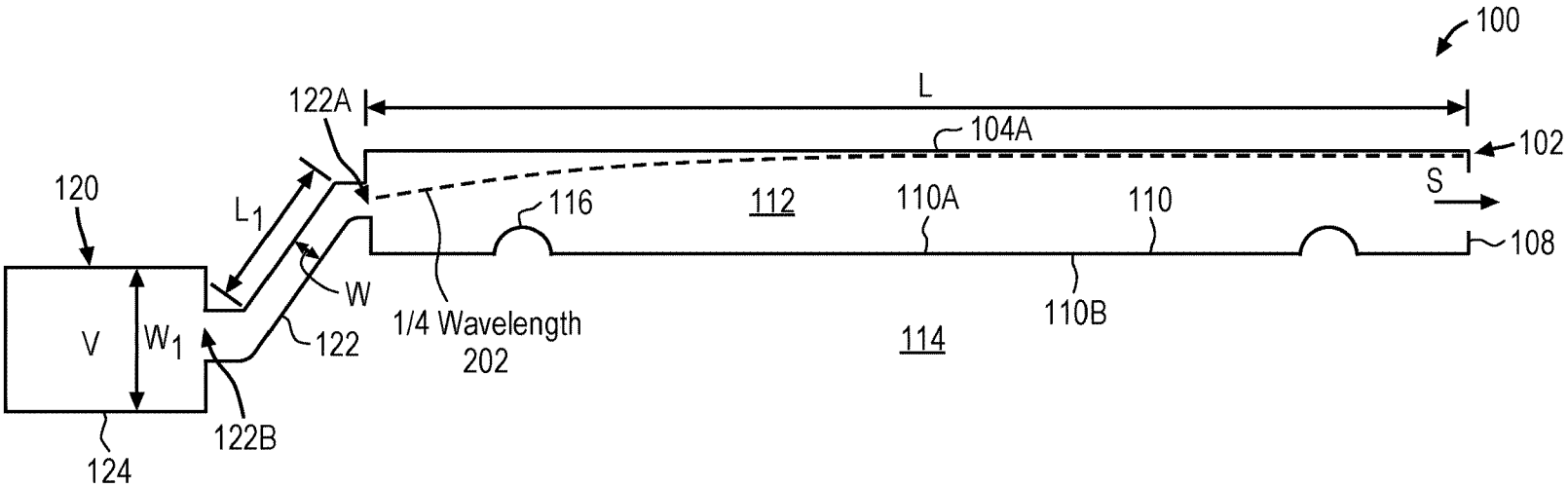
FIG. 2 illustrates a simplified schematic cross-sectional view of the transducer assembly of FIG. 1.

FIG. 2 illustrates a simplified cross-sectional schematic diagram of the transducer and resonator of FIG. 1. In particular, as can be seen from FIG. 2, first chamber 112, which may be formed by enclosure wall 104A and the top face 110A of SRS 110, is essentially an acoustic channel or tube through which sound (S) can travel to acoustic port 108. As previously discussed, every open-ended air channel, or a tube, has a fundamental frequency or quarter wavelength that is linked to the length of the channel or tube (e.g., only a quarter of the wavelength can occur in that length of tube). Thus, first chamber 112 has a quarter wavelength 202 that corresponds to its length (L). When the wavelength of the frequency, generated by SRS 110, coincides with the quarter wavelength, the radiated sound loudness increases. This frequency may be referred to as the Quarter Wave Resonance (QWR) of the first chamber 112. To influence this QWR (e.g., increase a frequency bandwidth), resonator 120 is, in turn, tuned to resonate at the same frequency as the QWR of first chamber 112. Representatively, the resonator cavity volume (V), neck opening area or width (W) and/or neck length ($L_1$) of resonator 120 may be calibrated, tuned, or otherwise selected, so that resonator 120 resonates at the same frequency as the QWR of first chamber 112. For example, neck 122 may have an area or opening width (W) that is relatively narrow, for example narrower than the area or width ($W_1$) of acoustic cavity 124, and that is tuned with respect to the neck length ($L_1$), cavity width ($W_1$) or volume (V) to achieve the desired resonance. In addition, in order to influence the QWR, the opening 122A to resonator 120 should be positioned at a distance from acoustic port 108 corresponding to at least the length (L) corresponding to the quarter wavelength or the pressure maximum of first chamber 112. In particular, when resonator 120 is positioned at this particular location, resonator 120 can spread the energy of the QWR towards lower and higher frequencies to extend the frequency bandwidth of the transducer.

Figure 3:
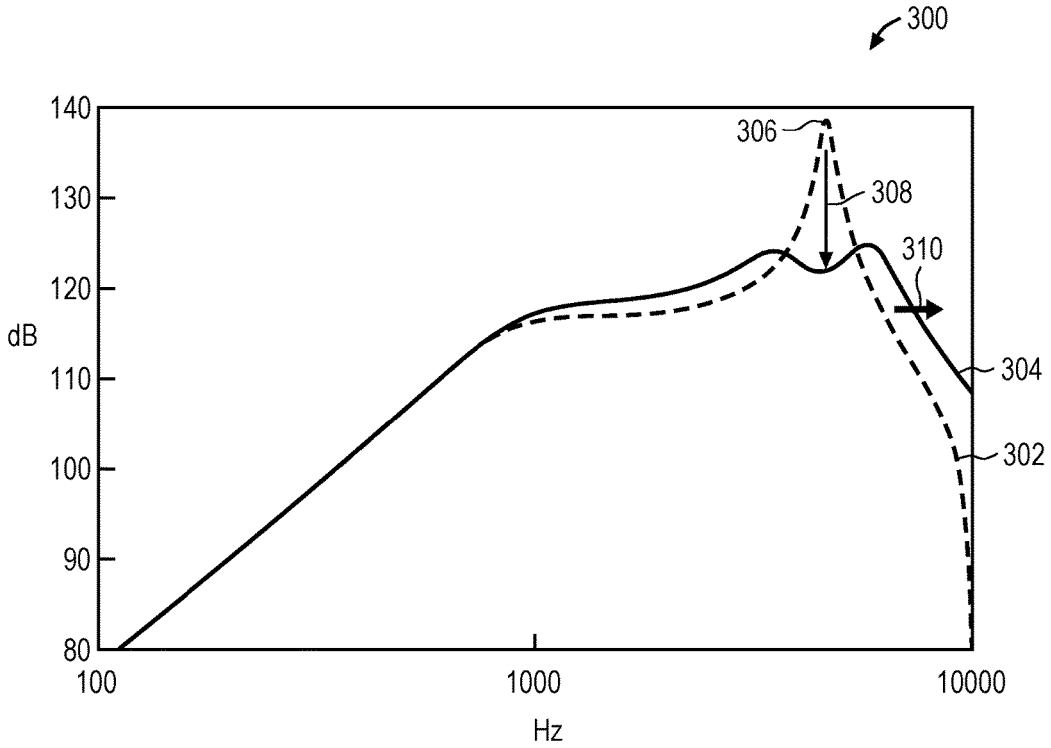
FIG. 3 illustrates one embodiment of a graph showing an enhanced frequency bandwidth achieved using the resonator of FIG. 1 and FIG. 2.

To further illustrate this improved bandwidth, FIG. 3 shows a graph comparing transducer systems with and without the resonator disclosed herein. In particular, the dashed line 302 of graph 300 shows the frequency bandwidth of a system without a front port resonator as disclosed herein, and the solid line 304 shows the frequency bandwidth of a system with the front port resonator. As can be seen from line 302, in a transducer without a front port resonator, when the wavelength of the frequency generated by the speaker coincides with the QWR of the air channel length, the radiated sound loudness increases, as illustrated by peak 306. In addition, after this increase, the loudness diminishes significantly. These irregularities in sound loudness can be perceived by the user as poor sound quality. As can be seen from line 304, however, the presence of the front port resonator disclosed herein helps to flatten the frequency response at the QWR (as illustrated by arrow 308), bring each frequency to equal loudness levels, and also extend the frequency bandwidth (as illustrated by arrow 310). This increase in the efficiency of the transducer outside the QWR improves sound quality for the user.

Figure 4:
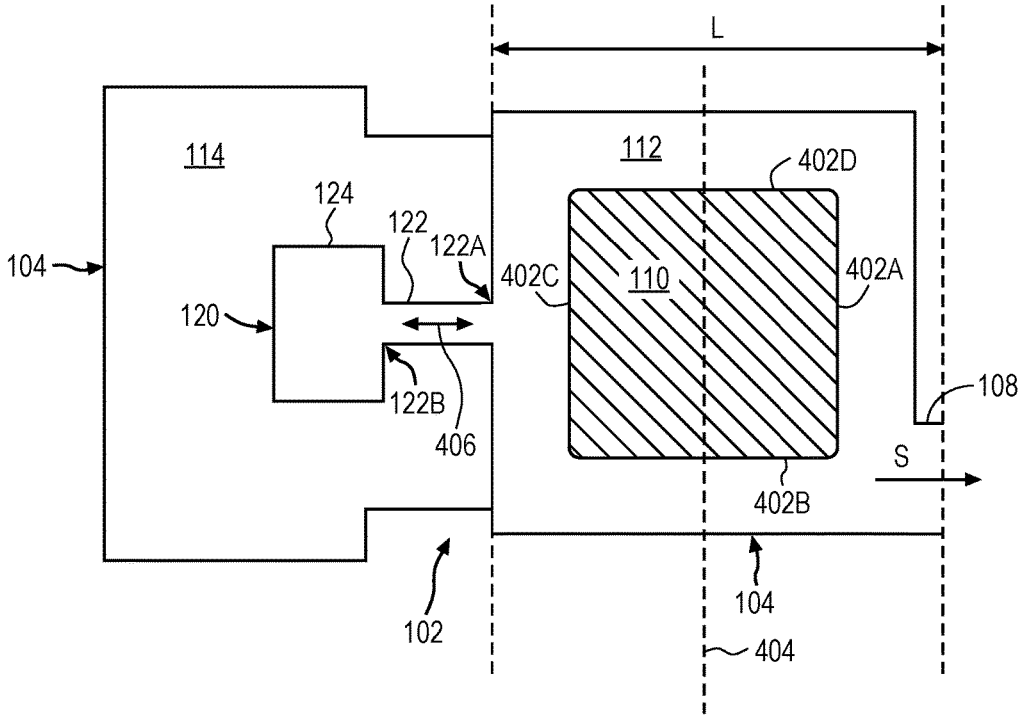
FIG. 4 illustrates a simplified schematic top plan view of the transducer assembly of FIG. 1.

Referring now to FIG. 4, FIG. 4 illustrates a simplified schematic diagram of a top plan view of the transducer and front port resonator described in reference to FIG. 1. Representatively, from this view, it can be seen that in one embodiment, resonator 120 is positioned within second chamber 114 of enclosure 102. In addition, the opening 122A from resonator 120 to first chamber 112 is located at a distance from the acoustic port 108 that corresponds to the quarter wavelength of first chamber 112, or length (L) as described in reference to FIG. 2. This location of opening 122A corresponding to length (L) may also be considered a pressure maximum of first chamber 112. Therefore the location of opening 122A may also be defined as being at the pressure maximum of first chamber 112. This length (L) may be greater than a distance from the acoustic port 108 to a center axis 404 of sound radiating surface 110. Therefore the location of resonator opening 122A may further be defined with respect to center axis 404. For example, the location of opening 122A may be considered to be one that is at a distance from the acoustic port 108 that is greater than a distance from the acoustic port 108 to center axis 404.

In addition, from this view it can be seen that in one embodiment, the sound radiating surface 110 may be defined by four sides 402A, 402B, 402C and 402D which connect to form a square shaped sound radiating surface 110. The opening 122A to resonator 120 may be along one side 402C of sound radiating surface 110 while the acoustic port 108 is positioned along another side 402A of sound radiating surface 110. Thus, resonator 120 may also be described as having a position in which opening 122A is along a side of sound radiating surface 110 different from that of acoustic port 108, for example opening 122A may be along an opposite side 402C to that of acoustic port 108 as shown. In addition, in some embodiments, the neck 122 of resonator 120 may be positioned such that opening 122A opens, or otherwise faces, a same direction as illustrated by arrow 406, as acoustic port 108. Said another way, opening 122A may open, or otherwise face a direction that is perpendicular to the center axis 404 of sound radiating surface 110.

Figure 5:
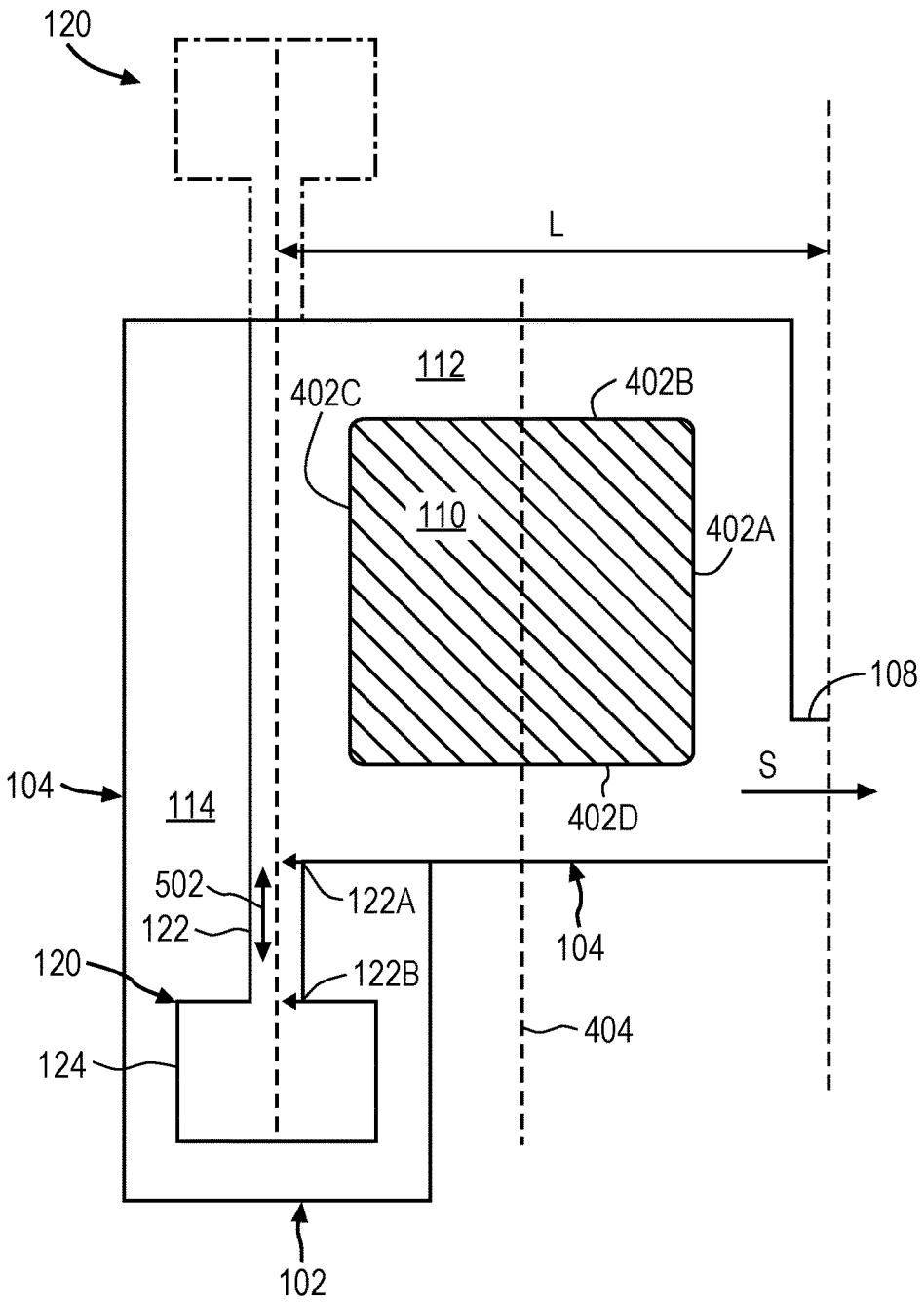
FIG. 5 illustrates a simplified schematic top plan view of another embodiment of a transducer assembly.

Other resonator configurations, however, are contemplated. For example, FIG. 5 shows a simplified schematic top plan view of another embodiment in which resonator 120 is positioned at the quarter wavelength, length (L), of first chamber 112, however, along a different side of sound radiating surface 110 than what is illustrated in FIG. 4. Representatively, in this embodiment, resonator 120 is shown positioned along a side 402D that is adjacent to the side 402A that acoustic port 108 is formed along. It is contemplated, however, that resonator 120 could also be positioned along side 402B, as shown by dashed lines. The opening 122A to resonator 120, however, is still positioned at the quarter wavelength, length (L), of first chamber 112. In this case, however, opening 122A to first chamber 112 faces or opens in a direction 502 that is parallel to center axis 404 of sound radiating surface 110. Said another way, opening 122A faces or opens in a different direction than acoustic port 108, for example, a direction that is perpendicular to acoustic port 108. It can also be seen that in this embodiment, although resonator 120 opens to first chamber 112 via opening 122A, acoustic cavity 124 is still positioned within second chamber 114, and within the encased space formed by enclosure wall 104.

Figure 6:
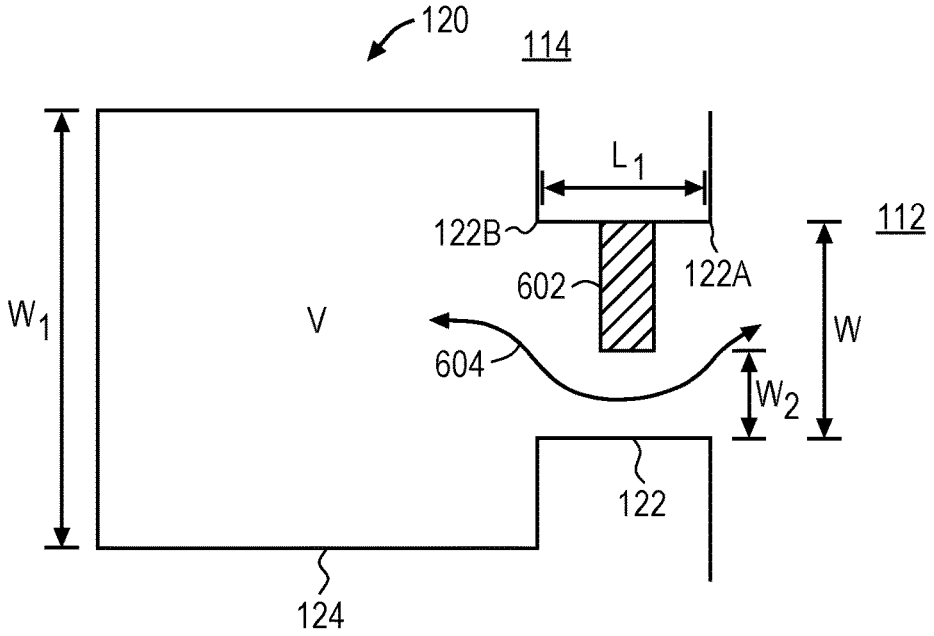
FIG. 6 illustrates a simplified schematic top plan view of another embodiment of a resonator.
Figure 7:
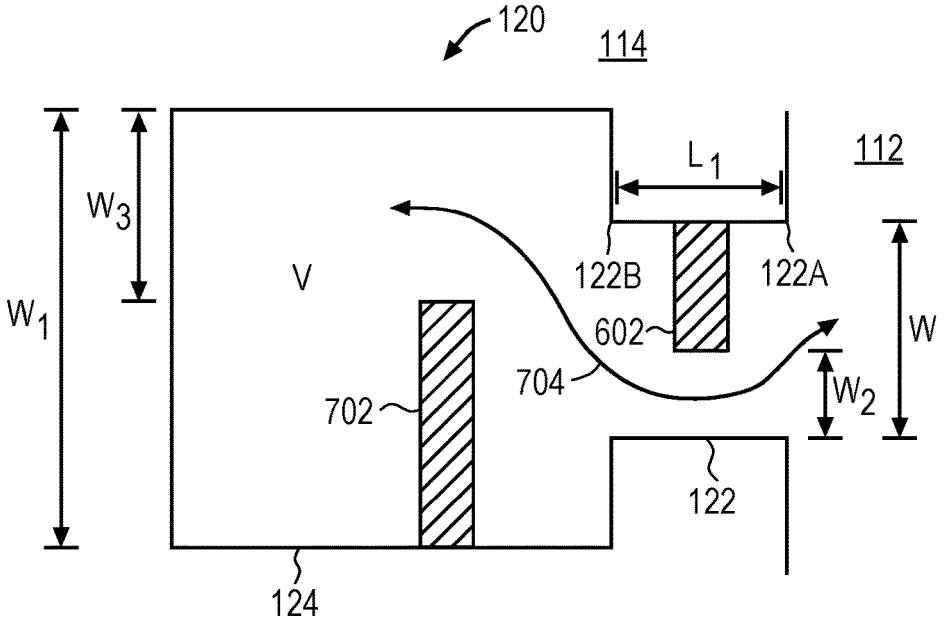
FIG. 7 illustrates a simplified schematic top plan view of another embodiment of a resonator.

Referring now to FIG. 6 and FIG. 7, FIG. 6 and FIG. 7 illustrate simplified cross-sectional schematic views of one embodiment of a resonator. Representatively, FIG. 6 shows resonator 120 including an acoustic channel, duct or neck 122 that opens to acoustic cavity 124, as previously discussed. As previously discussed, neck 122 may have a width (W) and length ($L_1$), and define an acoustic pathway between acoustic cavity 124 and first chamber 112 of enclosure 102. Acoustic cavity 124 may also have a width ($W_1$) and define an acoustic volume (V). In some embodiments, the width (W) of neck 122 may be smaller, or narrower, than the width ($W_1$) of acoustic cavity 124. Opening 122A to first chamber 112 and/or opening 122B to acoustic cavity 124, may therefore be considered relatively narrow with respect to the size of acoustic cavity 124 and/or first chamber 112. One or more of the neck width (W) and/or length ($L_1$) and acoustic volume (V) of acoustic cavity 124 may be calibrated, or tuned, so that resonator 120 resonates at a same frequency as the quarter wave resonance of first chamber 112.

In addition, in some embodiments, resonator 120 may include a damping feature, which can help to reduce a magnitude of the peak (e.g. peak 306 in FIG. 3) in close proximity to the resonance and amplify frequencies outside the resonance frequency bands. Representatively, in one embodiment, neck 122 may include at least one damping member 602, for example a barrier, that creates a tortuous flow path 604 through neck 122. Damping member 602 may, for example, be positioned along the interior surface of neck 122 and extend into, or otherwise partially occlude, a portion of the acoustic pathway defined by neck 122. In this aspect, neck 122 may be considered to have an interior width that varies between regions having a width (W) as previously discussed, and narrower regions having a width ($W_2$). Damping member 602 may be a structure and/or material of any shape and size suitable for creating a tortuous pathway within neck 122. For example, damping member 602 could be an interior wall integrally formed with the same material as neck 122 (e.g., a plastic), or could be a different material than neck 122, for example, a damping material. It should further be understood that damping member 602 need not be an additional structure or protrusion extending from the interior surface of neck 122, but instead should be broadly understood as representing any bend, turn, zig-zag or similar configuration that an interior surface of neck 122 may have to create a tortuous pathway. For example, damping member 602 may represent one or more of the bends defining the tortuous pathway created by the bending or meandering neck 122 shown in FIG. 1 and FIG. 2.

FIG. 7 illustrates another embodiment of a resonator similar to that of FIG. 6, except in this embodiment, the acoustic cavity 124 also includes a damping member 702. Representatively, damping member 702 may similar to damping member 602 described in reference to FIG. 6 except that it extends from the interior surface of acoustic cavity 124, and creates a tortuous flow path 704 through acoustic cavity 124. In this aspect, acoustic cavity 124 may also have an interior width that varies between regions having a width ($W_1$) as previously discussed, and regions having a narrower width ($W_2$).

Figure 8:
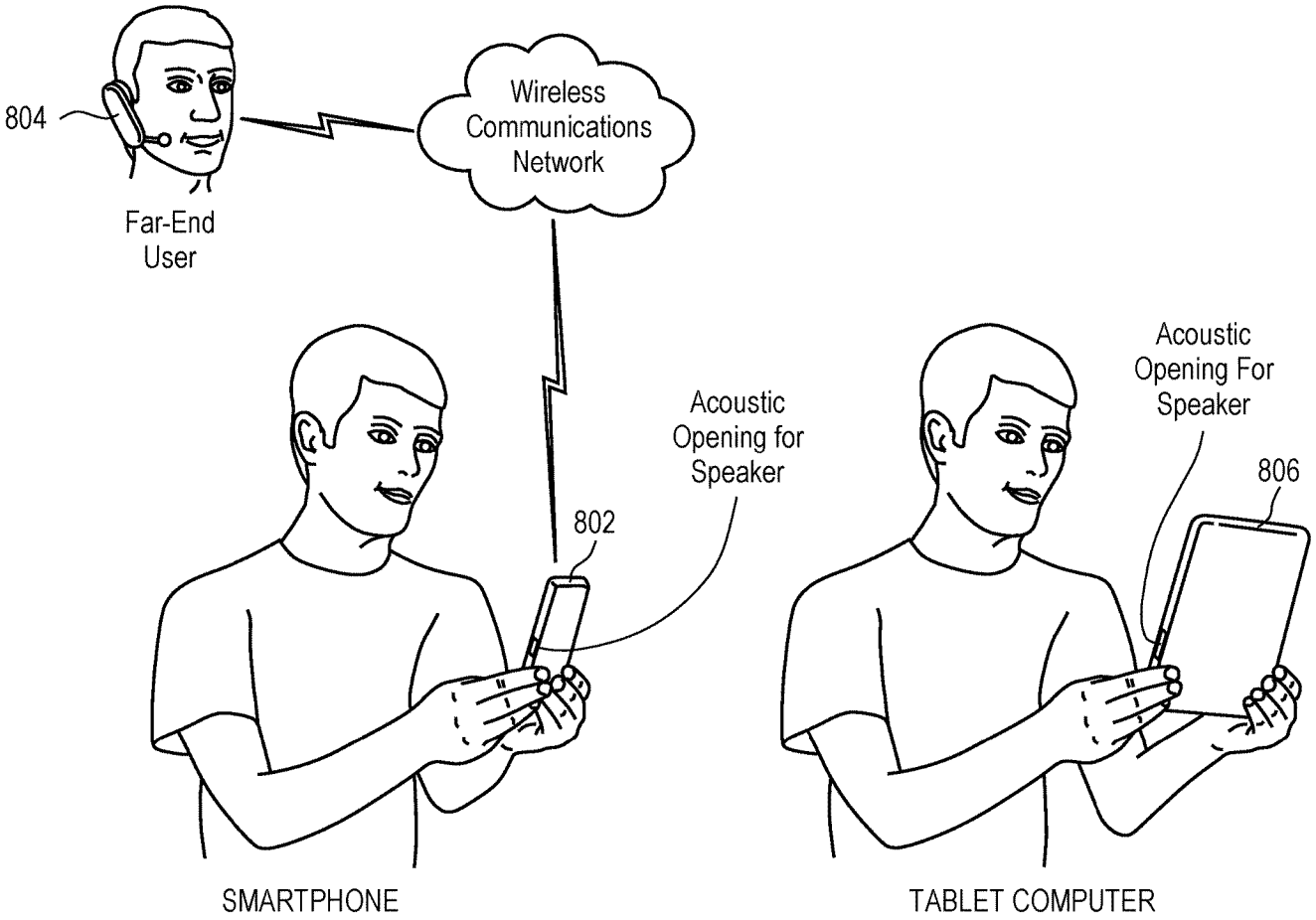
FIG. 8 illustrates one embodiment of a simplified schematic view of one embodiment of an electronic device in which one or more embodiments may be may be implemented.

FIG. 8 illustrates one embodiment of a simplified schematic view of one embodiment of an electronic device in which a transducer (e.g., a micro speaker), such as that described herein, may be implemented. As seen in FIG. 8, the transducer may be integrated within a consumer electronic device 802 such as a smart phone with which a user can conduct a call with a far-end user of a communications device 804 over a wireless communications network; in another example, the speaker may be integrated within the housing of a tablet computer 806. These are just two examples of where the speaker described herein may be used, it is contemplated, however, that the speaker may be used with any type of electronic device in which a transducer, for example, a loudspeaker or microphone, is desired, for example, a tablet computer, a desk top computing device or other display device.

Figure 9:
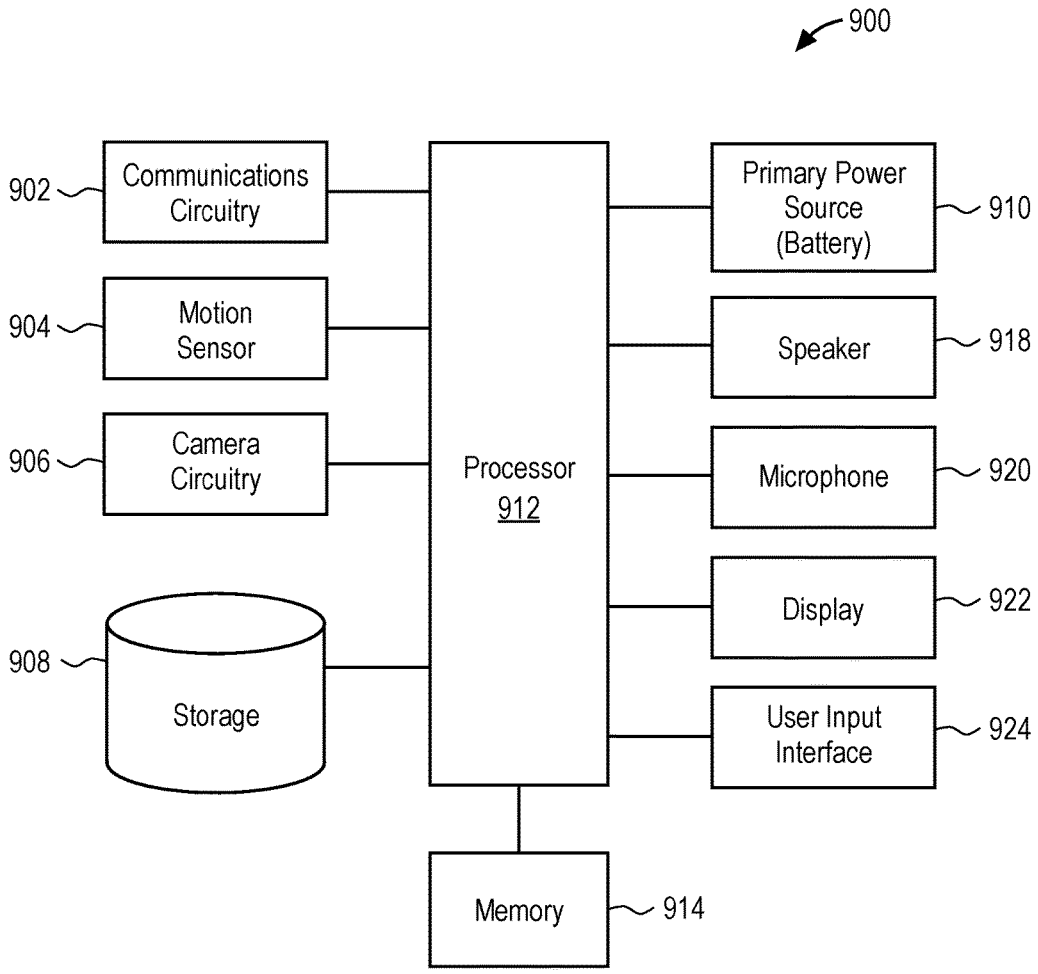
FIG. 9 illustrates a block diagram of some of the constituent components of an embodiment of an electronic device in which one or more embodiments may be implemented.

FIG. 9 illustrates a block diagram of some of the constituent components of an embodiment of an electronic device in which one or more embodiments may be implemented. Device 900 may be any one of several different types of consumer electronic devices. For example, the device 900 may be any transducer-equipped mobile device, such as a cellular phone, a smart phone, a media player, or a tablet-like portable computer.

In this aspect, electronic device 900 includes a processor 912 that interacts with camera circuitry 906, motion sensor 904, storage 908, memory 914, display 922, and user input interface 924. Main processor 912 may also interact with communications circuitry 902, primary power source 910, speaker 918 and microphone 920. Speaker 918 may be a micro speaker such as that described in reference to FIG. 1. The various components of the electronic device 900 may be digitally interconnected and used or managed by a software stack being executed by the processor 912. Many of the components shown or described here may be implemented as one or more dedicated hardware units and/or a programmed processor (software being executed by a processor, e.g., the processor 912).

The processor 912 controls the overall operation of the device 900 by performing some or all of the operations of one or more applications or operating system programs implemented on the device 900, by executing instructions for it (software code and data) that may be found in the storage 908. The processor 912 may, for example, drive the display 922 and receive user inputs through the user input interface 924 (which may be integrated with the display 922 as part of a single, touch sensitive display panel). In addition, processor 912 may send an audio signal to speaker 918 to facilitate operation of speaker 918.

Storage 908 provides a relatively large amount of "permanent" data storage, using nonvolatile solid state memory (e.g., flash storage) and/or a kinetic nonvolatile storage device (e.g., rotating magnetic disk drive). Storage 908 may include both local storage and storage space on a remote server. Storage 908 may store data as well as software components that control and manage, at a higher level, the different functions of the device 900.

In addition to storage 908, there may be memory 914, also referred to as main memory or program memory, which provides relatively fast access to stored code and data that is being executed by the processor 912. Memory 914 may include solid state random access memory (RAM), e.g., static RAM or dynamic RAM. There may be one or more processors, e.g., processor 912, that run or execute various software programs, modules, or sets of instructions (e.g., applications) that, while stored permanently in the storage 908, have been transferred to the memory 914 for execution, to perform the various functions described above.

The device 900 may include communications circuitry 902. Communications circuitry 902 may include components used for wired or wireless communications, such as two-way conversations and data transfers. For example, communications circuitry 902 may include RF communications circuitry that is coupled to an antenna, so that the user of the device 900 can place or receive a call through a wireless communications network. The RF communications circuitry may include a RF transceiver and a cellular baseband processor to enable the call through a cellular network. For example, communications circuitry 902 may include Wi-Fi communications circuitry so that the user of the device 900 may place or initiate a call using voice over Internet Protocol (VOIP) connection, transfer data through a wireless local area network.

The device may include a microphone 920. Microphone 920 may be an acoustic-to-electric transducer or sensor that converts sound in air into an electrical signal. The microphone circuitry may be electrically connected to processor 912 and power source 910 to facilitate the microphone operation (e.g., tilting).

The device 900 may include a motion sensor 904, also referred to as an inertial sensor, that may be used to detect movement of the device 900. The motion sensor 904 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RF or acoustic doppler detector, a compass, a magnetometer, or other like sensor. For example, the motion sensor 904 may be a light sensor that detects movement or absence of movement of the device 900, by detecting the intensity of ambient light or a sudden change in the intensity of ambient light. The motion sensor 904 generates a signal based on at least one of a position, orientation, and movement of the device 900. The signal may include the character of the motion, such as acceleration, velocity, direction, directional change, duration, amplitude, frequency, or any other characterization of movement. The processor 912 receives the sensor signal and controls one or more operations of the device 900 based in part on the sensor signal.

The device 900 also includes camera circuitry 906 that implements the digital camera functionality of the device 900. One or more solid state image sensors are built into the device 900, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 908. The camera circuitry 906 may also be used to capture video images of a scene.

Device 900 also includes primary power source 910, such as a built in battery, as a primary power supply.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the various speaker components described herein could be used in an acoustic-to-electric transducer or other sensor that converts sound in air into an electrical signal, such as for example, a microphone. The description is thus to be regarded as illustrative instead of limiting.

What is claimed is:

1. A micro speaker assembly comprising:

an enclosure having an enclosure wall separating a surrounding environment from an encased space, wherein the enclosure wall defines an acoustic port from the encased space to the surrounding environment;

a sound radiating surface positioned within the encased space and dividing the encased space into a front volume chamber and a back volume chamber, wherein the front volume chamber is acoustically coupled to a first surface of the sound radiating surface and the acoustic port, and the back volume chamber acoustically coupled to a second surface of the sound radiating surface;

a resonator acoustically coupled to the front volume chamber, wherein the resonator and the acoustic port are positioned along different sides of the sound radiating surface, and the resonator comprises a neck acoustically coupled to a closed acoustic cavity, and an opening to the neck is positioned at a distance from the acoustic port that corresponds to a quarter wavelength resonance of the front volume chamber;

a voice coil extending from the second surface of the sound radiating surface; and a magnet assembly having a magnetic gap aligned with the voice coil.

2. The micro speaker assembly of claim 1 wherein the distance from the acoustic port that corresponds to the quarter wavelength resonance is greater than a distance from the acoustic port to a center axis of the sound radiating surface, and the resonator is on a different side of the center axis than the acoustic port.

3. The micro speaker assembly of claim 1 wherein the resonator is tuned to resonate at a same frequency as a quarter wave resonance of the front volume chamber such that it extends a frequency bandwidth of a sound generated by the sound radiating surface.

4. The micro speaker assembly of claim 1 wherein the neck of the resonator comprises a narrower cross-section than the closed acoustic cavity.

5. The micro speaker assembly of claim 1 wherein the opening to the neck of the resonator faces a different direction than the acoustic port.

6. The micro speaker assembly of claim 1 wherein the neck of the resonator defines a tortuous acoustic pathway.

7. The micro speaker assembly of claim 1 wherein the closed acoustic cavity defines a tortuous acoustic pathway.

8. The micro speaker assembly of claim 1 wherein the resonator is positioned within the enclosure and the closed acoustic cavity occupies a portion of the back volume chamber within the encased space.

9. The micro speaker assembly of claim 1 wherein the closed acoustic cavity is acoustically isolated from the back volume chamber.

10. The micro speaker assembly of claim 1 wherein the enclosure wall comprises a top wall that is parallel to a bottom wall, and a side wall connecting the top wall to the bottom wall, and wherein the resonator is formed in part by at least one of the top wall, the bottom wall of the side wall.

11. The micro speaker assembly of claim 1 wherein the enclosure wall comprises a top wall that is parallel to a bottom wall, and a side wall connecting the top wall to the bottom wall, and wherein the acoustic port is positioned within the side wall.

12. A micro speaker assembly comprising:

an enclosure having an enclosure wall separating a surrounding environment from an encased space, wherein the enclosure wall defines an acoustic port from the encased space to the surrounding environment;

a sound radiating surface positioned within the encased space and dividing the encased space into a front volume chamber acoustically coupled to a first surface of the sound radiating surface and a back volume chamber acoustically coupled to a second surface of the sound radiating surface, and wherein the front volume chamber is acoustically coupled to the acoustic port;

a Helmholtz resonator acoustically coupled to the front volume chamber and the acoustic port, and wherein a closed cavity of the Helmholtz resonator is positioned within the back volume chamber and is not acoustically coupled to the back volume chamber;

a voice coil extending from the second surface of the sound radiating surface; and a magnet assembly having a magnetic gap aligned with the voice coil.

13. The micro speaker assembly of claim 12 wherein the Helmholtz resonator is operable to extend a frequency bandwidth of a sound generated by the sound radiating surface in comparison to a micro speaker assembly without a Helmholtz resonator.

14. The micro speaker assembly of claim 12 wherein the Helmholtz resonator is tuned to resonate at a same frequency as a quarter wave resonance of the front volume chamber.

15. The micro speaker assembly of claim 12 wherein an opening to the Helmholtz resonator is positioned at a pressure maximum of a quarter wave resonance of the front volume chamber.

16. The micro speaker assembly of claim 12 wherein the Helmholtz resonator is acoustically coupled to the front volume chamber at a location that is farther from the acoustic port than a center axis of the sound radiating surface.

17. The micro speaker assembly of claim 12 wherein the Helmholtz resonator comprises an interior damping member that forms a tortuous acoustic pathway within the Helmholtz resonator.

18. The micro speaker assembly of claim 12 wherein a perimeter of the sound radiating surface is defined by four sides, and the Helmholtz resonator is positioned along a side of the sound radiating surface that is different than the acoustic port.

19. An electroacoustic transducer assembly comprising:

an enclosure separating a surrounding environment from an encased space, wherein the enclosure comprises a top wall, a bottom wall and a side wall connecting the top wall to the bottom wall, and an acoustic port formed within the side wall and connecting the encased space to the surrounding environment;

a driver positioned within the encased space, the driver comprising a sound radiating surface dividing the encased space into a front volume chamber and a back volume chamber, wherein the front volume chamber is acoustically coupled to the acoustic port and defined in part by the top wall and a first surface of the sound radiating surface that faces the top wall, and the back volume chamber is defined in part by the bottom wall and a second surface of the sound radiating surface; and a resonator acoustically coupled to the front volume chamber, wherein the resonator comprises an acoustic channel having one end open to the front volume chamber and another end open to a closed acoustic cavity, and wherein the closed acoustic cavity is positioned within the back volume chamber.

20. The electroacoustic transducer assembly of claim 19 wherein the one end of the acoustic channel is open to the front volume chamber at a location that is a distance from the acoustic port that corresponds to a quarter wavelength resonance of the front volume chamber, the only acoustic pathway to the closed acoustic cavity is through the another open end of the acoustic channel, and the closed acoustic cavity is positioned between the second surface of the sound radiating surface and the bottom wall.

* * * * *